US008990091B2

(12) United States Patent
Lerner et al.

(10) Patent No.: US 8,990,091 B2
(45) Date of Patent: Mar. 24, 2015

(54) PARSIMONIOUS PROTECTION OF SENSITIVE DATA IN ENTERPRISE DIALOG SYSTEMS

(75) Inventors: Solomon Z. Lerner, Sharon, MA (US); Mark Fanty, Norfolk, MA (US)

(73) Assignee: Nuance Communications, Inc., Burlington, MA (US)

( * ) Notice: Subject to any disclaimer, the term of this patent is extended or adjusted under 35 U.S.C. 154(b) by 308 days.

(21) Appl. No.: 13/560,274

(22) Filed: Jul. 27, 2012

(65) Prior Publication Data

US 2014/0032219 A1 Jan. 30, 2014

(51) Int. Cl.
*G10L 25/48* (2013.01)

(52) U.S. Cl.
CPC ..... *G10L 25/48* (2013.01)
USPC ..... 704/273

(58) Field of Classification Search
USPC ..... 704/273
See application file for complete search history.

(56) References Cited

U.S. PATENT DOCUMENTS

| | | | | |
|---|---|---|---|---|
| 7,103,553 | B2 * | 9/2006 | Applebaum et al. | 704/275 |
| 7,305,336 | B2 * | 12/2007 | Polanyi et al. | 704/9 |
| 7,606,714 | B2 * | 10/2009 | Williams et al. | 704/275 |
| 7,693,947 | B2 * | 4/2010 | Judge et al. | 709/206 |
| 8,036,897 | B2 * | 10/2011 | Smolenski et al. | 704/270 |

* cited by examiner

*Primary Examiner* — Susan McFadden
(74) *Attorney, Agent, or Firm* — Hamilton, Brook, Smith & Reynolds, P.C.

(57) ABSTRACT

In one embodiment, a method comprises classifying a representation of audio data of a dialog turn in a dialog system to a classification. The method may further comprise taking a security action on the classified representation of the audio data of the dialog turn as a function of the classification. The security action can be suppressing the representation of the audio data, encrypting the representation of the audio data, releasing the representation of the audio data, partially suppressing the representation of the audio data, partially encrypting the representation of the audio data, partially releasing the representation of the audio data, or a command.

18 Claims, 6 Drawing Sheets

FIG. 4

TEXT CONVERSATION LOG 502

| | |
|---|---|
| 504 | Q: Welcome to ACME, how may I help you? |
| 506 | C: I'd like to check my account balance<br>A: Text="I'd like to check my account balance", Meaning={Action:GetBalance} |
| 508 | Q: What is your social security number? |
| 510 | C: 123456789<br>A: Text="<suppressed or encrypted>", Meaning={SSNum:<S or E> SSNum4Dig:6789 |
| 512 | Q: What is your birthday? |
| 514 | C: Can you please repeat the question?<br>A: Text="Can you please repeat the question?", Meaning={Cmd:Repeat} |
| 516 | Q: I was asking for your birthday in order to verify your identity. What is your birthday? |
| 518 | C: July 4, 1950<br>A: TEXT="<S or E>", Meaning={Birthday:<S or E>} |

FIG. 5

PARSIMONIOUS PROTECTION OF SENSITIVE DATA IN ENTERPRISE DIALOG SYSTEMS

BACKGROUND OF THE INVENTION

In many applications, security of customer data is an important concern. While companies may need to use personally identifying information of a customer for various purposes, companies may try to limit exposure of personally identifying information. Further, customers may only trust companies with their personally identifying information with quality data security policies.

SUMMARY OF THE INVENTION

In one embodiment, a method comprises classifying a representation of audio data of a dialog turn in a dialog system to a classification. The method may further comprise taking a security action on the classified representation of the audio data of the dialog turn as a function of the classification.

In another embodiment, the security action can be: suppressing the representation of the audio data, encrypting the representation of the audio data, releasing the representation of the audio data, partially suppressing the representation of the audio data, partially encrypting the representation of the audio data, partially releasing the representation of the audio data, or a command.

In another embodiment, classifying the representation of audio data in the dialog system further includes identifying metadata corresponding to the representation of the audio data indicating the classification. The method may further include identifying a grammar within the representation of the audio data of the dialog turn indicating a change in the classification indicated by the metadata based on a meaning of the audio data of the dialog turn.

In another embodiment, taking the security action on the classified representation of the audio data includes suppressing the classified audio data or encrypting the audio data in any location where the classified audio data is stored. The representation of audio data may be stored as a representation of a whole audio call, a representation of an audio response to a prompt, an operating information text log, or a debugging information text log.

In another embodiment, a system includes a dialog system. The dialog system includes a classification module configured to classify a representation of audio data of a dialog turn to a classification. The dialog system further includes a security action module configured to take a security action on the classified representation of the audio data of the dialog turn as a function of the classification.

In another embodiment, a non-transitory computer readable medium is configured to store instructions comprising, in a processor configured to execute the instructions, classifying a representation of audio data of a dialog turn in a dialog system to a classification. The instructions may further include taking a security action on the classified representation of the audio data of the dialog turn as a function of the classification.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 5 is a diagram illustrating a text conversation log including personally identifying information.

DETAILED DESCRIPTION OF THE INVENTION

A description of example embodiments of the invention follows.

Figure 1:
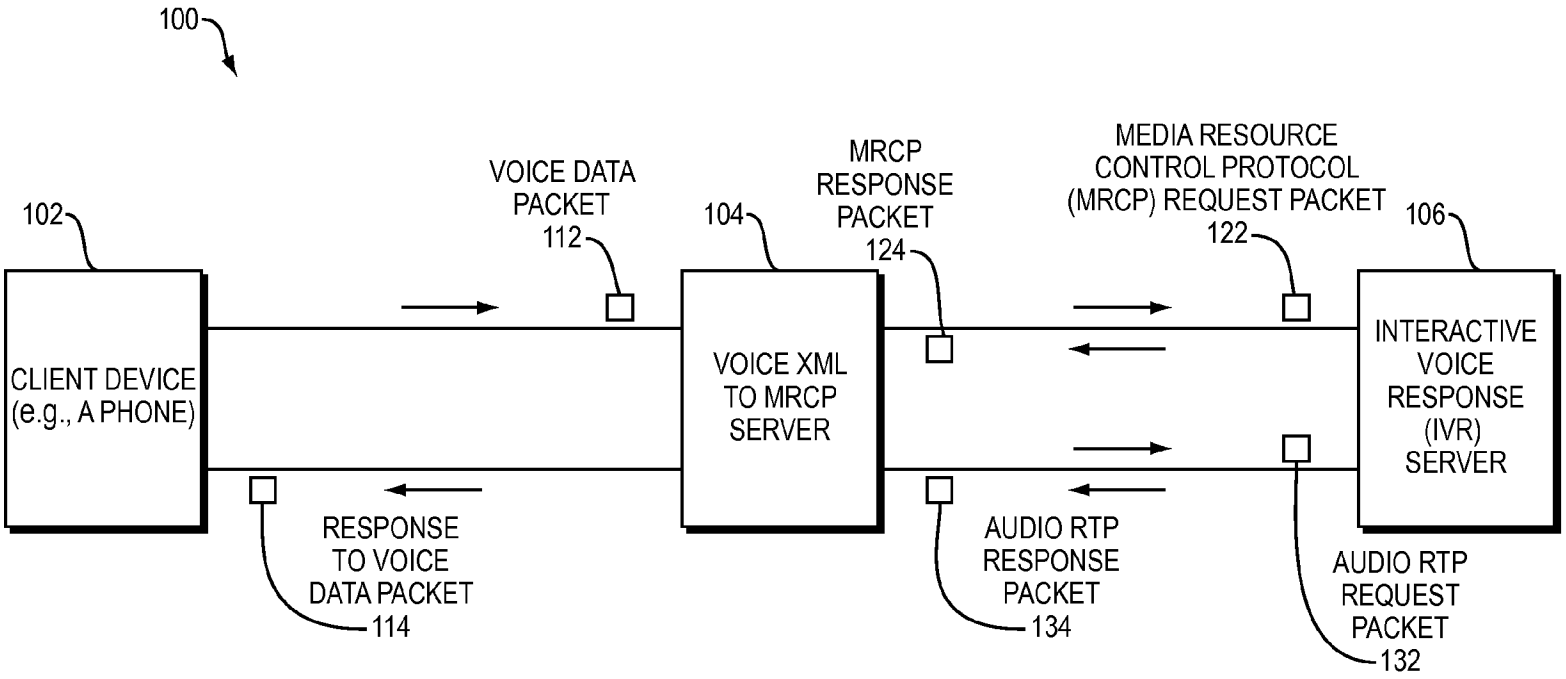
FIG. 1 is a block diagram illustrating an example embodiment of an interactive voice response server configured to interact with a client device and a voice-XML-to-media-resource-control-protocol server.

FIG. 1 is a block diagram 100 illustrating an example embodiment of an interactive voice response (IVR) server 106 configured to interact with a client device 102 and a voice-XML-to-media-resource-control-protocol (MRCP) server 104. The client device 102 (e.g., a phone) transmits a voice data packet 112 to the voice-XML-to-MRCP server 104. The voice-XML-to-MRCP server 104 generates a MRCP request packet 122 to the IVR server 106.

The IVR server 106 receives the MRCP request packet 122. MRCP is often employed by a server, dialog server, or a FAQ-based server, such as the IVR server 106. The MRCP request packet 122 requests that the IVR server 106 makes available a resource for speech processing. For example, the MRCP request packet 122 can request that the IVR server 106 open a port to receive audio data. The IVR server 106 responds by generating a MRCP response packet 124, which can allocate the resource, such as the port, or deny the resource to the voice-XML-to-MRCP server 104.

When the IVR server 106 grants speech resources to the voice-XML-to-MRCP server 104, the voice-XML-to-MRCP server 104 sends a audio real-time protocol (RTP) request packet 132. In one embodiment, the voice-XML-to-MRCP server 104 directs the audio RTP request packet 132 to a port specified in the MRCP response packet 124. The IVR server 106 responds by generating an audio RTP response packet 134. The audio RTP response packet 134 can be a vocalized response to the audio RTP request packet 132. The voice-XML-to-MRCP server 104 then sends a response to voice data packet 114 to the client device 102. The user of the client device 102 can then read or listen to the response of the IVR server 106.

In some embodiments, the voice-XML-to-MRCP server 104 represents an enterprise client. An enterprise client can be a company such as a bank that makes available an automated phone service line by partnering with a third-party that hosts the IVR server 106. A customer of the enterprise client can use a client device 102 to call the voice-XML-to-MRCP server 104. The voice-XML-to-MRCP server 104, in conjunction with the IVR server 106, provides automated customer service or technical support to the user of the client device 102.

In certain embodiments, when a different party hosts the IVR server 106 than the voice-XML-to-MRCP server 104, the enterprise client may have certain data security policies regarding personally identifying information (PII) of its customers. For example, an enterprise client, such as a bank, may ask a customer to verify his or her identity using PII such as a Social Security number or a birthday before using certain aspects of the IVR system 106. The customer and enterprise client both desire that the third-party that hosts the IVR server 106 does not store the PII of the customer.

In an IVR server 106, a turn of dialog can represent one side of a dialog between two or more parties. For example, the IVR server 106 asking a question represents one turn of dialog. The user answering the question represents another turn of dialog.

On the other hand, the third-party that hosts the IVR server 106 may desire to keep a log of customer calls to improve the quality of its customer service. For example, the third-party that hosts the IVR server 106 can review logs of customer interactions with the IVR server 106 to fine tune the IVR server 106 or resolve a dispute between the enterprise client that hosts the voice-XML-to-MRCP server and the customer. For example, a designer of the IVR server 106 can improve the questions the IVR server 106 asks by reviewing logs. Further, the enterprise client can review logs to help resolve disputes with the customer. The third-party that hosts the IVR server 106 further does not need to see the customer's PII, such as a Social Security number or a birthday. Therefore, in one embodiment, an IVR server 106 can analyze data of a turn of dialog in real-time, before logging any data, to determine whether the data is PII or otherwise confidential or sensitive. Data that is not PII can be logged, either in a text or audio file. Data that is PII can be suppressed, removed from the log, or encrypted with a key owned and held by the enterprise client. In this manner, the IVR server 106 provides parsimonious protection of PII, while allowing the IVR server 106 to log dialog without PII.

In providing parsimonious protection, the IVR server 106 can protect PII stated by the customer and by the IVR server 106. An example of PII stated (enunciated or otherwise rendered) by the IVR server 106 can include a question such as "Can you confirm your social security number is 123-45-6789." Another example could be, after the customer has provided PII to identify him or herself to the IVR server 106, "Are you taking your asthma medicine regularly?," where the PII is the user's medical condition of asthma. In this manner, the representation of the questions posed by the IVR server 106 as audio questions can also be classified.

Figure 2:
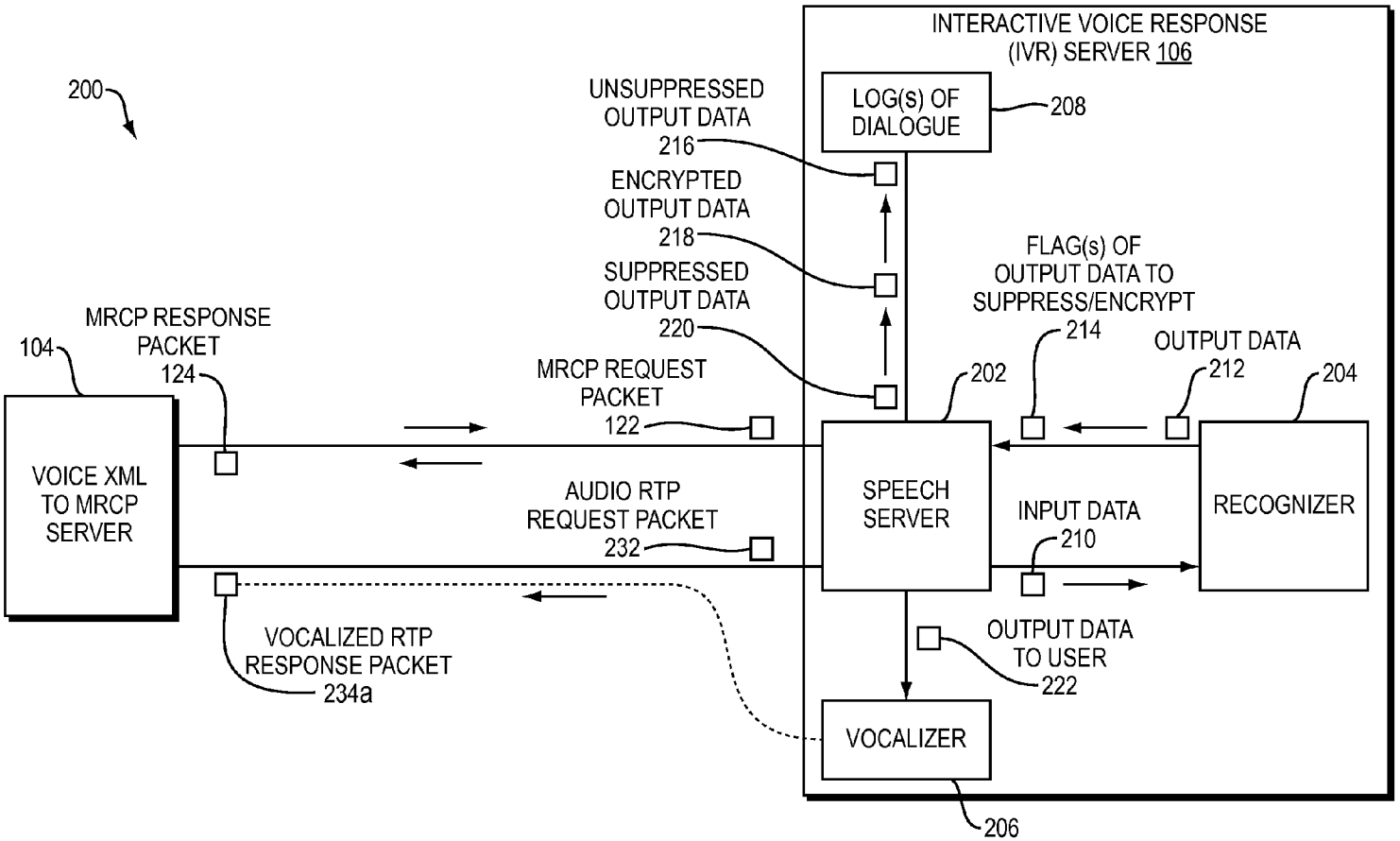
FIG. 2 is a block diagram illustrating example embodiments of an interactive voice response server configured to encrypt or suppress sensitive data.

FIG. 2 is a block diagram 200 illustrating example embodiments of an IVR server 106 configured to encrypt or suppress sensitive data. The IVR server 106 receives the MRCP request packet 122 from the voice-XML-to-MRCP server 104. The IVR server 106 then responds by generating the MRCP response packet 124 which indicates one or more available speech resources on the IVR server 106. The MRCP response packet 124 can further indicate an interpretation or response to previously received audio data. Then, the voice-XML-to-MRCP server 104 issues an audio RTP request packet 232 to a speech server 202 within the IVR server 106. The speech server 202 sends input data 210 (e.g., voice data) from the audio RTP request packet 232 to the recognizer. The recognizer 204 then interprets the input data 210 and returns output data 212. Output data 212 can be a speech-to-text interpretation of the input data 210 (e.g., voice data within the audio RTP request packet 232). The recognizer 204 further outputs flag(s) 214 of the output data 212 to suppress/encrypt.

The flags 214 mark any PII within the output data 212 as confidential, sensitive, or critical, to be suppressed and/or encrypted at a later time.

The speech server 202 receives both the output data 212 and flag(s) 214. The speech server 202 interprets the flag(s) 214 and determines whether the output data includes any confidential or sensitive data (e.g., PII). If the flag(s) 214 indicate the output data 212 includes no PII, the speech server 202 sends unsuppressed output data 222 to a log of dialog module 208 for storage. Then, the speech server 202 sends to vocalizer 206 the output data to the user 222. In response, the vocalizer 206 generates a vocalized RTP response packet 234.

If the speech server 202 determines the flag(s) 214 of the output data indicate suppression or encryption, the speech server 202 executes procedures to suppress or encrypt output data. In one embodiment, in creating a text log, the speech server 202 suppresses or encrypts only the PII of the customer and releases the remainder of the text to the log. In this manner, the speech server 202 sends unsuppressed output data 216 to the log(s) of dialog module 208, and sends encrypted output data 218 or suppressed output data 220 to the log(s) of dialog module 208 as well. The text log therefore includes the text of all unsuppressed data and encrypted or indications of suppressed PII.

If the speech server 202 records an audio call in the log, the speech server can either log a response to an individual turn of dialog (e.g., an answer to a question) or log the entire call. If the speech server 202 records individual answers of a customer, only in the log an individual answer containing PII is flagged to be suppressed or encrypted. An answer that does not contain PII is flagged to be released. For example, an answer stating the user's account number is flagged to be suppressed or encrypted, however an answer stating that the user would like to check his balance is released because it contains no PII.

If the speech server 202 is configured to record audio of the entire call, then the speech server 202 encrypts or suppress PII within the audio of the entire call, and releases non-personally identifying information within the audio of the entire call. For example, if the call asked for the user's birthday, and the user stated it, the speech server 202 outputs the user's birthday as encrypted output data 218 or suppressed output data 220 as part of the entire recording. A suppressed PII in an audio recording can be blank audio. The speech server 202 can also suppress or encrypt the turn of dialog including the user's birthday. However, if the user only asked the IVR server 106 for non-personally identifying information, such as hours of a branch of a bank, the speech server 202 sends unsuppressed output data 222 to the logs of dialog module 208.

Figures 3, 4:
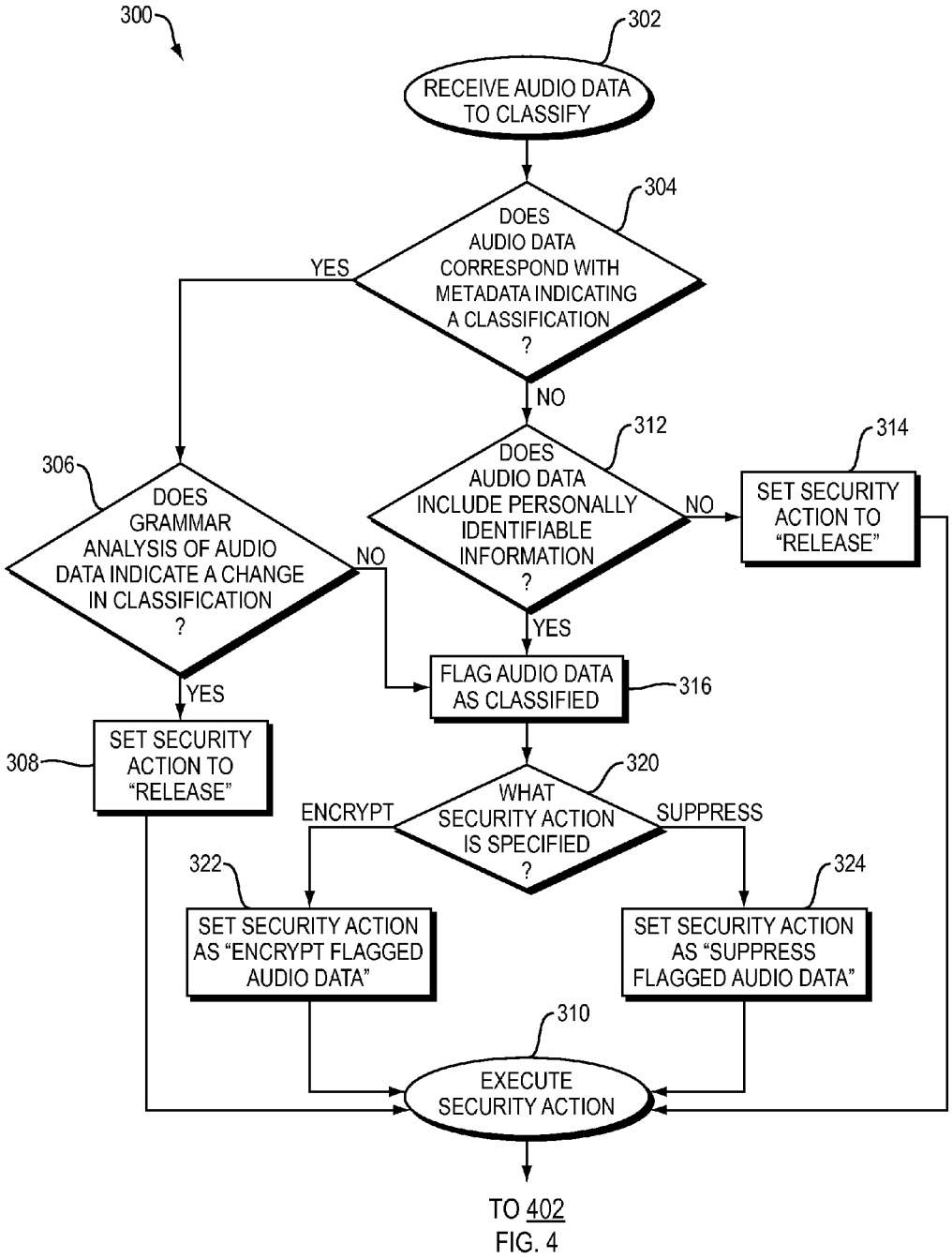
FIG. 3 is a flow diagram illustrating an example embodiment of determining a security action based on audio data.
FIG. 4 is a flow diagram illustrating an example embodiment of executing a security action.
Figure 4:
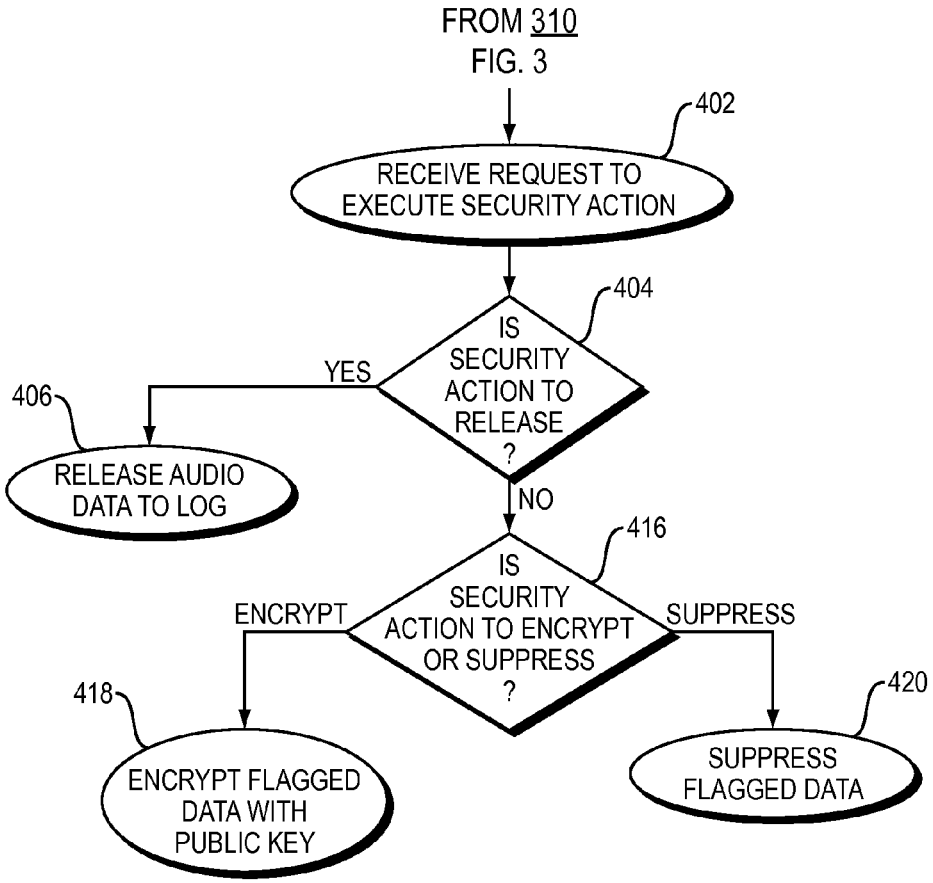

FIG. 3 is a flow diagram 300 illustrating an example embodiment of determining a security action based on audio data. The recognizer (FIG. 2) first receives audio data to classify (302). Then, the recognizer determines whether the received audio data corresponds with metadata indicating a classification (304). For example, the audio data can be accompanied with a tag that indicates that the audio data is likely to include PII. For example, if the user is responding to a question asking for PII, the audio RTP request packet can include a tag stating that the audio data is likely to include a piece of sensitive data. If the audio data does correspond with such a metadata tag (304), the recognizer then determines whether a grammar analysis of the audio data indicates that there is no PII, and that the classification should be changed (306). For example, even if the recognizer asks for PII, the user may not provide it. The user may instead ask to repeat the question, as one example. In this scenario, the recognizer can detect, using grammar, that the audio data includes no PII and sets the security action to "release" (308). The speech server (FIG. 2) then executes the security action (310).

On the other hand, when the grammar analysis does not indicate a change in classification (306), the recognizer flags the audio data as classified (316). Then, the recognizer determines which security action the IVR server is configured to execute for the audio data (320). The security action can be set, for example, by a system setting in the IVR server, a configuration file that determines a security action based on the type of sensitive data, or metadata in the audio RTP packet. If the security action is to encrypt sensitive data, the recognizer sets the security action as "encrypt flagged audio data" (322). The speech server executes the security action (310). On other hand, if the security action is to suppress (320), the recognizer sets the security action as "suppress flagged audio data" (324). Then, the recognizer executes the security action (310).

If the audio data does not correspond with metadata indicating a classification (304), the recognizer determines whether the audio data includes PII (312). The recognizer determines whether the audio data includes PII based on speech to text recognition and grammar within the determined text. If the recognizer determines that the audio data does not include PII, the recognizer sets the security action to release (314). Then the speech server executes the security action (310). On the other hand, if the audio indicates classification (312), the recognizer flags the audio data as classified (316). The recognizer and speech server then proceed, as described above, to flagg audio data as classified (316), determine the security action specified (320, 322, 324) and execute the security action (310).

FIG. 4 is a flow diagram 400 illustrating an example embodiment of executing a security action. The speech server (FIG. 2) receives a request to execute a security action (402) from an execute security action command (310), as in FIG. 3. In relation to FIG. 4, the speech server then determines whether the security action is to release the data (404). If the security action is to release (404), the speech server releases the audio data to a log (406). If the security action is to encrypt or suppress (e.g., not to release) (404), the speech server determines whether the security action is to encrypt or to suppress (416). If the security action is to encrypt, the speech server encrypts the flagged data with a public key (418). The public key is stored by the IVR server and is employed to encrypt the flagged data, however cannot decrypt the flagged data. The enterprise client holds a private key. The enterprise client can use a decryption system to decrypt the flagged data, for example, in the case of a customer dispute where it is necessary to access the PII of the dialog. If the security action is to suppress (416), the system suppresses the flagged data (420). Suppressing the flagged data can include deleting the flagged data from a text log, or replacing the data with wildcards or other characters. On the other hand, if the system is logging audio, either as a audio full call or audio individual response, suppression stores blank audio or static instead of the PII.

FIG. 5 is a diagram 500 of a text conversation log 502 including PII. The text conversation log 502 is an example dialog between an IVR server and a customer and could also represent the content of an audio log. The IVR server first states a welcome message in a first dialog turn 504. In a second turn of dialog 506, the user replies that he would like to check his account balance. The IVR server then asks the user to state his Social Security number to verify his identity, in a third turn of dialog 508. The user answers by stating 123-45-6789, or his Social Security number, in a fourth turn of dialog 510. The IVR server determines the user has stated the PII, e.g., a Social Security number, and suppresses or encrypts the PII. In one embodiment, the IVR server only partially suppresses the PII, e.g., by logging the last four digits of the user's Social Security number.

Then, the IVR server asks for the user's birthday as secondary identification in a fifth turn of dialog 512. In a sixth turn of dialog 514, the user asks the IVR system to repeat the question. The IVR server determines the meaning of the sixth turn of dialog 514 is to repeat the question and releases the sixth turn of dialog 514 to the log. In one embodiment, the IVR system anticipates that the sixth turn of dialog 514 includes PII because it asked for the user to state PII. However, based on an analysis of the grammar of the sixth turn of dialog 514, the IVR system determines the meaning of the dialog to be a request to repeat the previous question and does not include PII. The IVR system, therefore, overrides the initial expectation of suppression or encryption and instead can release the sixth turn of dialog 514.

In the seventh turn of dialog 516, the IVR system asks again for the user's birthday. The user replies with a date, "Jul. 4, 1950" in an eight turn of dialog 518. The system determines the data is PII and suppresses or encrypts the eighth turn of dialog 518. In one embodiment, the IVR system anticipates that the eighth turn of dialog 518 includes PII because it asked for the user to state PII. Based on an analysis of the grammar of the eighth turn of dialog 518, the IVR system determines the meaning of the dialog to state the user's birthday as including PII. The IVR system, therefore, does not override the initial expectation of suppression or encryption and encrypts or suppresses the eighth turn of dialog 518.

Therefore, the text conversation log 502 includes suppressed or encrypted PII, e.g., the Social Security number and the birthday date. The PII, for example, can be shown as a series of '#'s, e.g., in the (three character, hyphen, two character, hyphen, four character) string format of the Social Security number. This shows a designer of the IVR server the format of a Social Security number, without compromising the user's identity. Alternatively, the log can display the last four digits of the Social Security number. Further, the PII of a birthday can be shown as a month flag and more '#'s symbols to represent the day and year. The designer of the system can further recognize that the flags and symbols represent a suppressed birthday.

Figure 6:
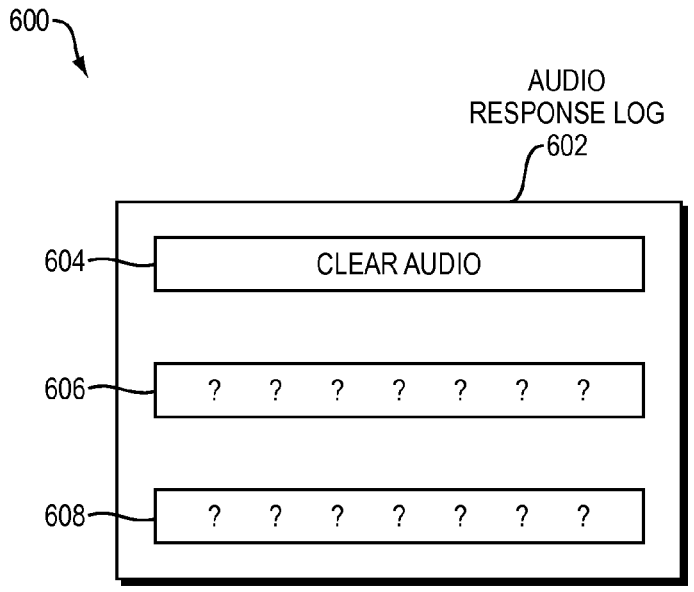
FIG. 6 is a diagram illustrating an audio response log.

FIG. 6 is a diagram 600 of an audio response log 602. The audio response log 602 includes an answer 604 with non-personally identifying information. The answer 604 is not suppressed and contains clear audio because it does not include PII. Next, the audio response log 602 includes a first encrypted answer 606 with PII. A designer of the IVR system cannot see the first encrypted answer 606 with PII because it is encrypted and only the enterprise client, and not the designer, has the key. Similarly, the second encrypted answer 608 with PII is also encrypted and cannot be accessed by the designer of the IVR system. The PII can also be suppressed by not creating a log entry for that turn of dialog or by creating a log entry and leaving it blank.

Figure 7:
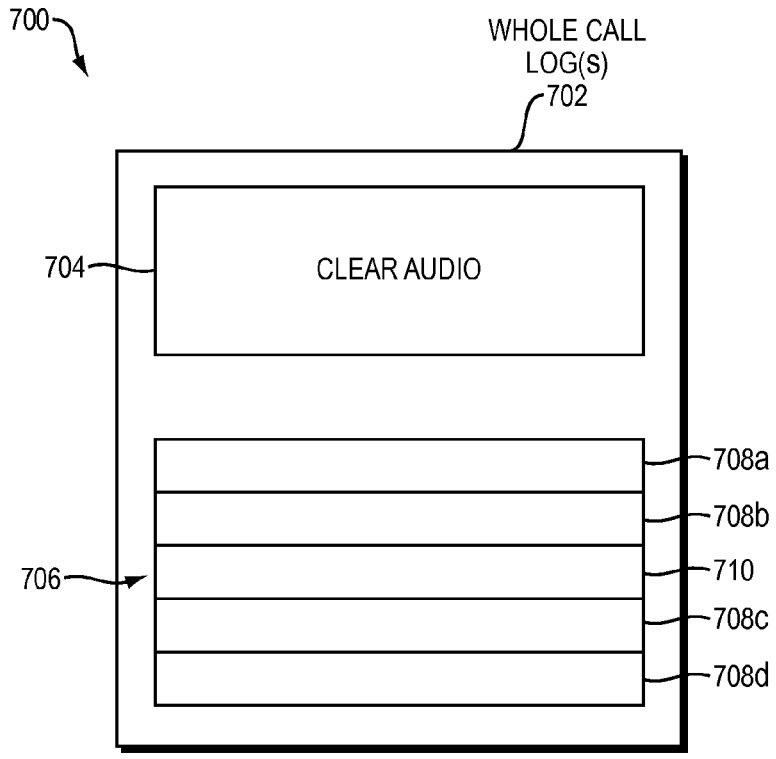
FIG. 7 is a diagram illustrating whole call logs.

FIG. 7 is a diagram 700 of whole call log(s) 702. The whole call log(s) 702 include a call with no PII 704, which is stored as clear audio because it does not have any PII. The whole call log(s) 702 further include a call with PII 706, which includes clear audio 708*a-d* of non-personally identifying information and suppressed or encrypted PII 710. The PII 710, if suppressed, is static, silent, or blank audio. The PII 710, if encrypted, cannot be accessed by anyone who does not have the private key. Again, the IVR server cannot access the encrypted data because it does not have the private key to decrypt it.

The teachings of all patents, published applications and references cited herein are incorporated by reference in their entirety. While this invention has been particularly shown and described with references to example embodiments thereof, it will be understood by those skilled in the art that various changes in form and details may be made therein without departing from the scope of the invention encompassed by the appended claims.

What is claimed is:

1. A method comprising:

classifying a representation of audio data of a dialog turn in a dialog system to a classification; and taking a security action on the classified representation of the audio data of the dialog turn as a function of the classification, the security action including at least one of at least partially suppressing the classified audio data and at least partially encrypting the audio data prior to storage of the classified audio data.

2. The method of claim 1, wherein taking the security action is at least one of releasing the representation of the audio data, partially releasing the representation of the audio data, and issuing a command.

3. The method of claim 1, wherein classifying the representation of audio data in the dialog system further includes identifying metadata corresponding to the representation of the audio data indicating the classification.

4. The method of claim 3, further comprising identifying a grammar within the representation of the audio data of the dialog turn indicating a change in the classification indicated by the metadata based on a meaning of the audio data of the dialog turn.

5. The method of claim 1, wherein taking the security action on the classified representation of the audio data includes suppressing the classified audio data or encrypting the audio data in any location where the classified audio data is stored.

6. The method of claim 5, wherein the representation of audio data is stored as at least one of a representation of a whole audio call, a representation of an audio response to a prompt, an operating information text log, and a debugging information text log.

7. A system comprising:

a dialog system including:

a classification module configured to classify a representation of audio data of a dialog turn to a classification; and a security action module configured to take a security action on the classified representation of the audio data of the dialog turn as a function of the classification; the security action module being further configured to at least partially suppress the classified audio data or at least partially encrypt the audio data prior to storage of the classified audio data.

8. The system of claim 7, the security action module is configured to take a security action being at least one of releasing the representation of the audio data, partially releasing the representation of the audio data suppression, and issuing a command.

9. The system of claim 7, wherein the classification module is further configured to identify metadata corresponding to the representation of the audio data of the dialog turn indicating the classification.

10. The system of claim 9, wherein the classification module is further configured to identify a grammar within the representation of the audio data of the dialog turn indicating a change in the classification indicated by the metadata and re-classify the representation of the audio data based on a meaning of the audio data of the dialog turn.

11. The system of claim 7, wherein the security action module is further configured to suppress the classified audio data or encrypt the audio data in any location where the classified audio data is stored.

12. The system of claim 11, further comprising a storage module configured to store the representation of audio data by storing at least one of a representation of a whole audio call, a representation of an audio response to a prompt, an operating information text log, and a debugging information text log.

13. A non-transitory computer readable medium configured to store instructions comprising:

a processor configured to execute the instructions of:

classifying a representation of audio data of a dialog turn in a dialog system to a classification; and taking a security action on the classified representation of the audio data of the dialog turn as a function of the classification, the security action including at least partially suppressing the classified audio data or at least partially encrypting the audio data prior to storage of the classified audio data.

14. The non-transitory computer readable medium of claim 13, wherein taking the security action is at least one of releasing the representation of the audio data, partially releasing the representation of the audio data suppression, and issuing a command.

15. The non-transitory computer readable medium of claim 13, wherein classifying the representation of audio data in the dialog system further includes identifying metadata corresponding to the representation of the audio data indicating the classification.

16. The non-transitory computer readable medium of claim 15, further comprising identifying a grammar within the representation of the audio data of the dialog turn indicating a change in the classification indicated by the metadata based on a meaning of the audio data of the dialog turn.

17. The non-transitory computer readable medium of claim 13, wherein taking the security action on the classified representation of the audio data includes suppressing the classified audio data or encrypting the audio data in any location where the classified audio data is stored.

18. The non-transitory computer readable medium of claim 17, wherein the representation of audio data is stored as at least one of a representation of a whole audio call, a representation of an audio response to a prompt, an operating information text log, and a debugging information text log.

* * * * *